United States Patent [19]

Wuepper et al.

[11] Patent Number: 4,836,266

[45] Date of Patent: Jun. 6, 1989

[54] METHOD AND APPARATUS FOR REGISTERING FLASKLESS SAND COPE AND DRAG MOLDS

[75] Inventors: Thomas E. Wuepper, Au Gres; Terry L. Franklyn, Fruitport, both of Mich.

[73] Assignee: CMI International, Inc., Southfield, Mich.

[21] Appl. No.: 210,403

[22] Filed: Jun. 23, 1988

[51] Int. Cl.[4] ..... B22C 17/00

[52] U.S. Cl. ..... 164/29; 164/37; 164/182; 164/213

[58] Field of Search ..... 164/29, 23, 27, 37, 164/169, 192, 194, 207, 209, 213, 214, 227, 243, 182

[56] References Cited

U.S. PATENT DOCUMENTS

| | | | |
|---|---|---|---|
| 3,229,336 | 1/1966 | Hunter et al. | 164/182 |
| 3,342,253 | 9/1967 | Hunter | 164/374 |
| 3,406,738 | 10/1968 | Hunter | 164/194 |
| 3,648,759 | 3/1972 | Lund et al. | 164/192 |
| 3,878,881 | 4/1975 | Lund et al. | 164/37 |
| 4,657,064 | 4/1987 | Hunter | 164/169 |

*Primary Examiner*—Richard K. Seidel
*Attorney, Agent, or Firm*—Harness, Dickey & Pierce

[57] ABSTRACT

A flaskless sand mold is formed in vertically aligned, sand-filled cope and drag flasks having a pattern board arranged between them so that pattern portions mounted upon the board extend upwardly into the cope and downwardly into the drag. The sand in the drag flask is supported upon a vertically guided platen which covers the bottom of the drag flask, and the cope is covered with a squeeze plate. The sand fillings are compressed against the pattern board and the pattern portions by the platen and squeeze plate to form compacted cope and drag sand molds with aligned cavities. Then the platen, supporting the drag sand mold, is lowered a short distance while the drag flask is held immovably against the cope flask. Thereafter, while the platen, with the drag sand mold, continues to lower, the drag frame is simultaneously lowered into a rest position upon a track-like support. When the drag sand mold reaches a position completely below the bottom of the drag flask, the drag flask is laterally moved out of the way, upon its support, along with the pattern board, and the platen is elevated until the drag sand mold upper surface engages the lower surface of the cope sand mold to form a closed flaskless sand mold with a casting cavity. Next, the closed sand mold is lowered until the cope sand mold is beneath the cope flask, and the sand mold is then moved transversely to a different location for casting metal.

17 Claims, 3 Drawing Sheets

METHOD AND APPARATUS FOR REGISTERING FLASKLESS SAND COPE AND DRAG MOLDS

This invention relates to a machine for automatically forming flaskless sand cope and drag molten metal casting molds.

Flaskless sand cope and drag molds are formed, in highspeed, automatic production, in separate cope and drag flasks, between which a pattern is located. By compressing sand within each of the flasks, the impression of the pattern is formed as the interface, that is, the adjacent faces, of the flasks which are vertically aligned for that purpose. Thereafter, the compressed sand cope and drag molds are removed from the flasks and are vertically aligned, with their pattern formed mold cavity in registry for use in casting molten metal.

One known, commercially available machine used for the production of sand molds is known as a "Hunter." That is, it is produced by the Hunter Automated Machinery Corp. of Schaumburg, Ill., U.S.A., from which it gets its name. The "Hunter" machine generally comprises a drag flask or frame whose open top is covered by a pattern board upon which a pattern is mounted. A portion of the pattern extends into the drag flask while the opposite portion is made to extend into a cope flask. The drag flask is, in the first instance, arranged in an inverted position and has a mechanism for dumping sand into the open, but inverted, bottom and upon the pattern board which closes it. Then, a support board is positioned upon the open bottom part, and the flask is turned 180 degrees to position the pattern board and patterns at its top and the support board at its bottom.

The sand-filled drag flask is moved laterally upon suitable tracks or supports into a position below an open cope flask or frame. A vertically movable platen moves upwardly to engage the support board and move it upwardly so as to compress the sand in the drag flask against the lower surface of the pattern board and pattern to thereby form a compressed sand drag mold.

When the drag flask is moved laterally to a location upon the support platen and beneath the cope flask, the drag flask is elevated by the upwardly moving platen so that the pattern board closes the open bottom of the cope flask. Sand is dumped into the cope, and the cope is covered by a squeeze plate. Thus, when the platen elevates to compress the sand within the drag flask, simultaneously both flasks are raised a small amount so that the sand within the cope flask is compressed between the upper surface of the pattern board and the squeeze plate to form the compressed sand cope mold.

After the compressed sand molds are formed, the drag flask, with its sand drag mold, is lowered, by lowering the platen, until the drag flask rests upon fixed supports. Typically, those fixed supports are "knives" or blades which engage the drag flask near its corners and hold it against further downward movement. Then, further downward movement of the platen, upon which the support board is rested, lowers the sand drag mold from the drag flask. After the sand drag mold is completely lowered below its drag flask, horizontal roller tracks are swung into a position to engage the opposite sides of the drag flask, raising it above its blade supports, so that the drag flask may be moved laterally from beneath the cope back to its original position for inversion and reloading with sand. Then, the platen may be elevated to raise the drag mold into contact with the sand cope mold.

Once the sand cope and drag molds are engaged, the platen may be lowered to remove the entire, closed mold from the cope flask. After that, the closed, now-flaskless mold may be moved laterally along suitable tracks or a supporting conveyor to a location for pouring metal.

This kind of machine, in operation, does not accurately register or align the sand drag mold rested upon the support board, in turn, supported upon the platen, with the sand cope mold located within the cope flask. That is, there is some misalignment which frequently occurs and, as a result, some small misalignments or casting problems that result from the slightly misaligned or inaccurately registered cope and drag cavities which together make up the enclosed casting cavity.

Thus, there has been a need in the "Hunter" type of machine for automatic, high-speed production of flaskless cope and drag sand molds, for a suitable mechanism for rapidly and highly accurately registering the drag sand mold, when it is free of the drag flask, with the sand cope mold during the time the sand cope mold is contained within the cope flask as well as during the removal of the cope mold from the cope flask in conjunction with the drag mold.

This invention relates to an improvement which provides rapid and accurate registry of the sand cope and drag molds and the handling of these molds without damaging them in the processing.

SUMMARY OF INVENTION

The invention herein contemplates an improvement to a sand cope and drag flaskless mold-producing machine which includes a cope flask and a drag flask which are vertically aligned, with a pattern board, containing pattern parts, arranged between them, and within which sand is compressed to form the sand molds. In this type of machine, the sand drag mold is supported upon a support board which, in turn, is supported upon a vertically movable platen.

The improvement herein relates to holding the drag flask immovably against the cope flask, while lowering the compacted sand drag mold a substantial distance downwardly within the immobile drag flask. Thereafter, the drag flask is lowered, along with the now-separate sand drag mold until the drag flask is stopped in its downward movement upon support tracks. Meanwhile, the platen and the sand drag mold continue downwardly until the sand drag mold is clear of the drag flask so that the drag flask may be laterally moved to a different location for refilling it with sand. After the drag mold, along with its pattern board, is laterally moved to its refill station, the platen may be vertically raised, between guide rails which guide its vertical upward and downward movement accurately, to engage the upper surface of the sand drag mold against the lower surface of the sand cope mold. Following that, the platen is again lowered so as to lower the cope mold from the cope flask and thereby lower the closed flaskless sand mold. The sand mold may then be laterally removed for casting use and the cycle is repeated.

Significantly, the invention contemplates holding the drag flask immobile while lowering the sand drag mold relative to it so as to avoid the previously produced misalignments that occurred when the drag flask was moved downwardly until it rested upon fixed support blades. That is, since the blades fitted into sockets formed in the bottom of the drag flask, the flask moved laterally slightly during the socket and blade interengagement. The present, accurate, guided lowering of the drag sand mold, independently of the unmoved flask, permits keeping the drag sand mold in accurate, vertical alignment with the sand cope mold.

In order to hold the drag flask in its upper position against the cope flask while lowering the drag sand mold, vertically extendable and retractable lift rods are mounted upon the platen. Thus, as the platen moves down, the lift rods are extended upwardly to hold the drag flask upwardly against the cope flask. The platen is moved downwardly until the sand drag mold is below the drag flask. The rods retract and lower the drag flask until it rests upon support tracks. Thereafter, the rods are retracted to free the drag flask for lateral movement on the tracks.

It can be seen that an object of this invention is to hold the drag flask immobile while lowering the sand drag mold from it. This prevents the sand drag mold from being shaken, laterally displaced, or otherwise moved out of its vertical alignment with the cope mold. This results in an accurate registration between the sand cope and drag molds. Also, it avoids damage to the sand drag mold due to prior lateral flask movement and permits a higher-speed separation of the sand drag mold from its flask.

A further object of this invention is to provide a simple, relatively inexpensive system for maintaining the initial vertical alignment between the sand cope and drag molds which results from forming the sand molds in vertically aligned flasks, while permitting rapid removal of the sand molds from the flasks.

Yet a further object of this invention is to permit increased speed of operation of the mold-forming machinery and process while, simultaneously, increasing the accuracy of registration of the sand molds formed in the cope and drag flasks of an automatic mold-making machine.

These and other objects and advantages of this invention will become apparent upon reading the following description, of which the attached drawings form a part.

DETAILED DESCRIPTION

Figure 1:
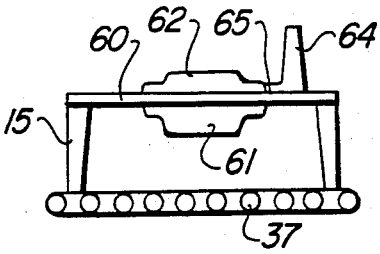
FIG. 1 schematically shows a drag flask with the pattern board and pattern covering its upper end.

FIGS. 14–17 schematically illustrate the machine. This includes a cope flask 10 which may be formed with angled or flat corners 11 upon which pairs of spaced apart guide rollers 12 are mounted. These rollers are arranged to engage opposite faces of vertical guide rails 13. Suitable stops 14 formed on the rails limit the downward movement of the cope flask relative to the guides.

A rectangular-shaped drag flask 15 is arranged beneath the cope flask. The drag flask 15 may be vertically aligned beneath the cope flask 10, as illustrated in dotted lines, or may be moved laterally to a position outwardly of the cope flask, as illustrated in solid lines in FIG. 14.

A vertically movable platen 19 is located beneath the cope flask and between guide rails 20 which may form an extension of the cope flask guide rails 13. Preferably, these guide rails 20 are arranged at a 45 degree angle relative to the cope guide rails for better controlling the relative vertical movement of the guided parts. The platen has corner blocks 21 upon which guide rollers 22 are mounted. The pairs of guide rollers engage adjacent faces of the guide rails 20 for guiding the vertical movement of the platen.

The blocks may include the vertically arranged cylinders 23 within which lift rods 24 are vertically movable. The lift rods may be piston rods which may be extended outwardly and vertically upwardly of the cylinders or retracted within the cylinders by suitable hydraulic or pneumatic fluid and fluid controls. Such fluid controls and operation are commercially available and therefore are not described in detail since they form no part of this invention.

A central, platen lift cylinder 28 is located beneath the platen and has an extensible piston rod 29 extending upwardly and connected to the platen. By the use of suitable hydraulic or pneumatic fluids and controls, the piston rod 29 may be extended to raise the platen which is guided in its upward movement by the block rollers 22 guided upon the guide rails 20.

The platen includes a ball-like connector 30 fastened by a flange 31 to the upper surface of the platen. This provides a universal type of joint or connection to an upper, secondary platen 32 which has a socket 33 for receiving the ball connector 30.

Support tracks 35, having suitable rollers 36, extend between the guide rails 20. The support tracks 35 are aligned with a pair of spaced apart support tracks 37 which form support track extensions that are connected to a frame and plate 38. This plate is supported upon rollers 39 fastened upon suitable fixed support brackets 40.

A large, elongated shaft 43 is journaled through a bearing 44 mounted upon the upper end of a support stanchion 45. The shaft may be rotated by a suitable motor, which is symbolized by a curved arrow 46. Also, the shaft may be moved endwise, as illustrated by the arrow 47.

A stack of cover or support boards 48 are located over the shaft 43. The boards may be moved, one by one, start with the lowermost board, over the uppermost part of the drag flask 15. The boards are held in place upon the flask by upper clamp rollers 49 fastened by connection strips 50 to the track extension 37. A suitable mechanical slide 51 is arranged to push the boards, one by one, over the drag flask 15.

A sand-filling hopper 54 is located above the drag flask. Over the hopper is a sand storage container 55, which is schematically illustrated. Arms 56 connect the sand-filling hopper 54 to a horizontally arranged squeeze plate 57. The hopper, with the attached squeeze plate, may be reciprocated in a horizontal plane so as to locate the hopper over the cope flask or the drag flask, and to locate the squeeze plate over the cope flask, as illustrated.

As schematically illustrated in FIG. 1, a pattern board 60 covers the upper, otherwise open end of the drag flask and is secured thereto. The pattern board may have a casting pattern formed with a drag part 61 and a cope part 62 on its lower and upper surfaces respectively. In addition, a sprue pin 64 and a gate-forming part 65 may be formed with the cope part of the pattern.

OPERATION

Figure 2:
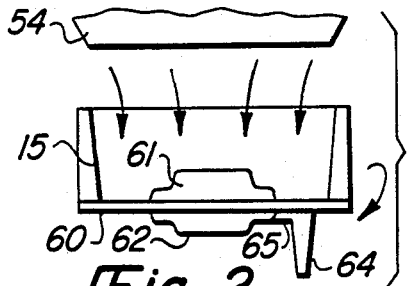
FIG. 2 schematically shows the drag flask inverted and with sand being dumped into it.

FIGS. 1–13 show the sequence of steps in the operation of the machine. Thus, FIG. 1 shows the drag flask 15 rested upon the support track extension 37. The pattern board 60 is on the uppermost surface of the drag flask, with the sprue pin 64 extending upwardly. Next, as illustrated in FIG. 2, the drag flask is turned upside-down by rotating the shaft 43 a half turn. The sand-filling hopper 54 is arranged above the open, uppermost end of the drag flask, and sand is dumped into it.

Figure 3:
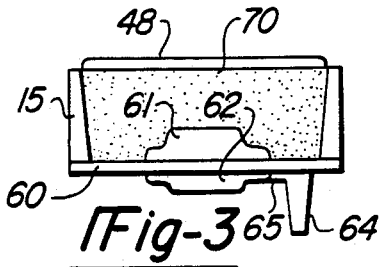
FIG. 3 illustrates the application of the support board cover.
Figure 4:
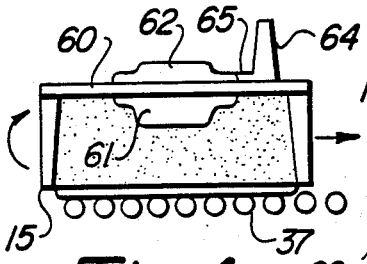
FIG. 4 schematically illustrates the drag flask, containing sand, inverted and moved laterally.
Figure 5:
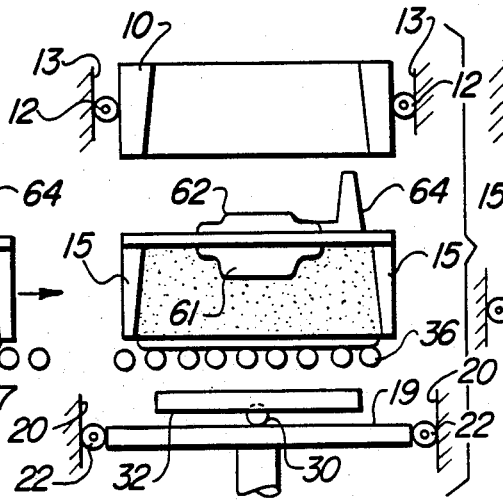
FIG. 5 schematically illustrates the drag flask arranged between the cope flask and the lift platen.

After the sand filling, the cover or support board 48 is slid over the drag flask, as illustrated in FIG. 3. Next, the drag flask is inverted, by again rotating the shaft 43, into the position shown in FIG. 4. By endwise extending the shaft 43, the drag flask is moved laterally upon the support tracks 35 beneath, and in vertical alignment, with the cope flask. This is illustrated in FIG. 5.

Figure 6:
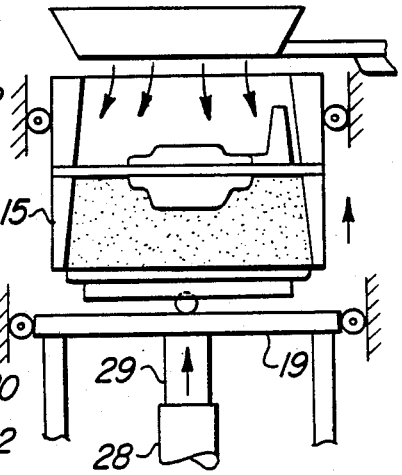
FIG. 6 schematically illustrates filling the cope flask with sand.

Next, the platen is raised, by upwardly extending its lift cylinder piston rod 29, so that the secondary platen 32 engages and supports the support board 48 (see FIG. 6). This raises the drag flask upwardly into alignment with and substantial engagement with the lower edges of the cope flask. More accurately, the pattern board 60 is arranged between the adjacent edges of the cope and drag flasks, as shown in FIG. 6. At that point, the sand-filled hopper 54 has been moved laterally to overlap the cope flask. Sand is dumped downwardly, by gravity, to fill the cope flask.

Figure 7:
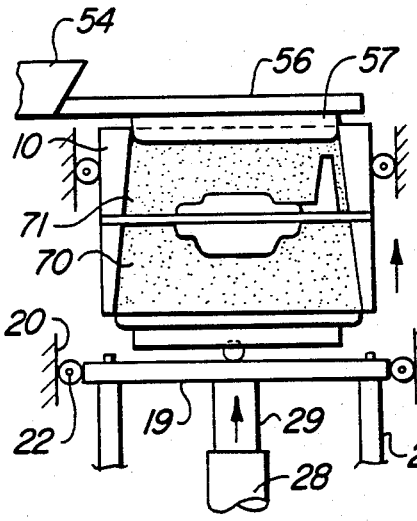
FIG. 7 schematically illustrates the compression of the sand within the cope and drag flasks.
Figure 8:
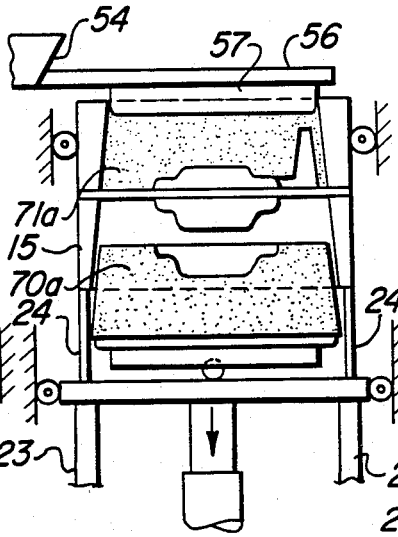
FIG. 8 illustrates the lowering of the sand drag mold while holding the drag flask upwardly against the cope flask.

After the cope flask is filled, the hopper 54 is moved laterally so that the squeeze plate 57 covers the top of the cope flask, as illustrated in FIG. 7. At that point, the platen 19 is raised further, thereby also raising the cope frame so that the squeeze plate 57 enters the cope frame. In this condition, the support board 48 squeezes the sand in the drag flask upwardly towards and against the bottom surface of the pattern board and the drag pattern portion 61. Simultaneously, the sand of the cope flask is squeezed by the squeeze plate 57 downwardly against the pattern board 60 and the cope pattern portions 62. This compacts the sand to form the drag sand mold **70*a* and cope sand mold 71*a***.

After the sand within the flasks is compacted, the lift rods 24 extend upwardly (see FIG. 8) to engage and support the lower edges of the drag flask 15. Meanwhile, the platen lift cylinder piston rod 29 is retracted so that the platen 19 lowers. The lowering of the platen takes with it the secondary platen 32 and the support board 48 upon which the drag sand mold **70*a*** is supported. Thus, while the drag flask is immobile against the cope flask, its compacted sand mold is moved downwardly and free of the flask.

Figure 9:
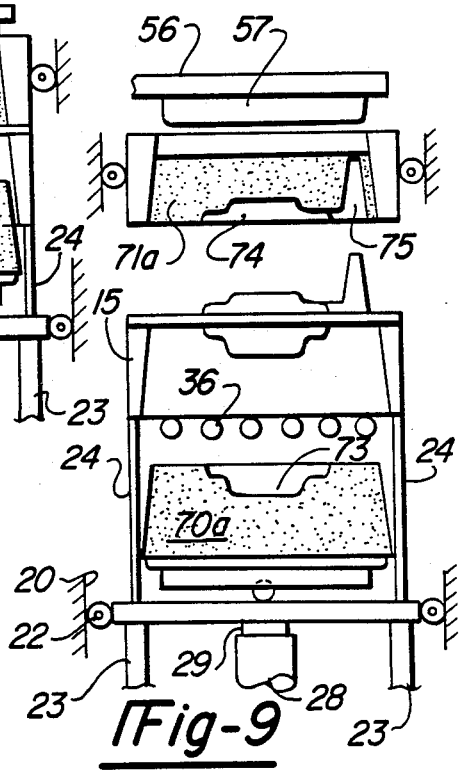
FIG. 9 illustrates the complete lowering of the sand drag mold beneath the drag flask and the drag flask rested upon its laterally movable support track and spaced beneath the cope flask.

After the sand mold moves downwardly a predetermined amount, that is, sufficiently to become free and spaced from the flask (which is exaggerated in the schematic drawing of FIG. 8), the drag flask begins its downward or lowering movement along with the platen. That is, the lift rods 24 continue to extend while the platen continues to lower relative to the drag flask so that the drag flask and the platen, with the sand mold, lower but at different rates so that they are also separated as they lower. FIG. 9 shows the platen in its lowermost position, with the sand drag mold lowered to a position well beneath the drag flask. This occurs after the drag flask settles down upon the support track 35 and thereby stops downward movement. At that point, with the support track holding the drag flask, and the platen having lowered the sand drag mold clear of the drag flask, the lift rods 24 may be retracted inwardly of their cylinders 23.

As can be seen in the schematic illustration of FIG. 9, the sand drag mold casting cavity 73 is open and exposed. Likewise, the cope mold cavity 74 is exposed when the drag flask, with the attached pattern board and pattern parts, are lowered.

Figure 10:
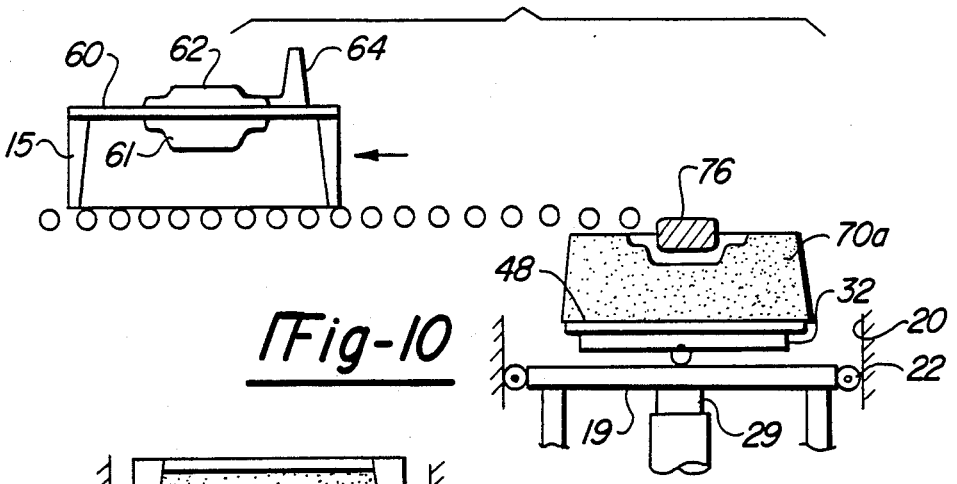
FIG. 10 schematically illustrates the drag flask moving laterally into its FIG. 1 position while a core is inserted in the cavity in the sand drag flask.

Next, as illustrated in FIG. 10, the empty drag flask is moved laterally back to the support track extension 27. As that occurs, a suitable core 76, which has been premade at a different location, is manually inserted into the drag cavity 73.

Figure 11:
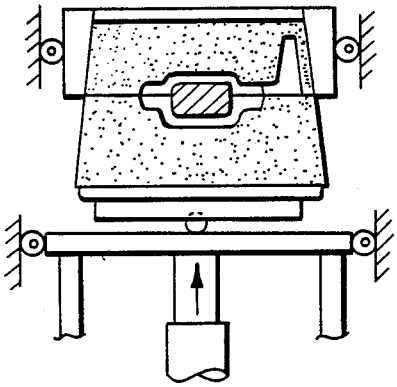
FIG. 11 illustrates the sand drag mold, with its core, lifted upwardly to engage the sand cope mold.
Figure 12:
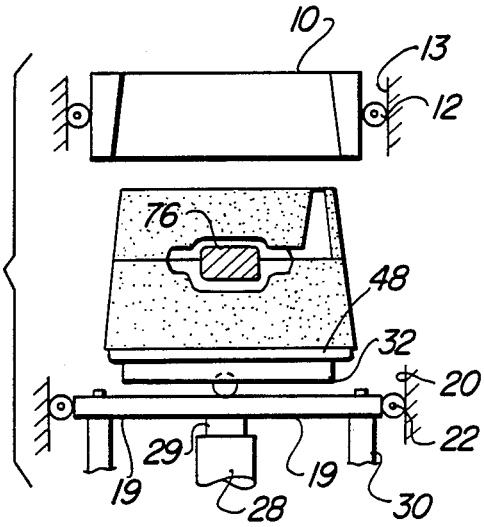
FIG. 12 illustrates the engaged cope and drag sand molds lowered beneath the cope flask.
Figure 13:
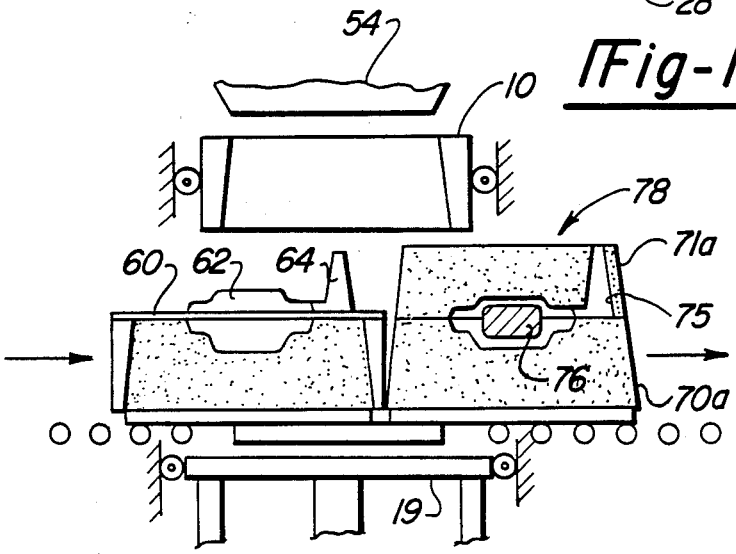
FIG. 13 illustrates the assembled, aligned cope and drag molds being pushed laterally by the incoming sand-filled drag flask to continue the cycle.
Figure 14:
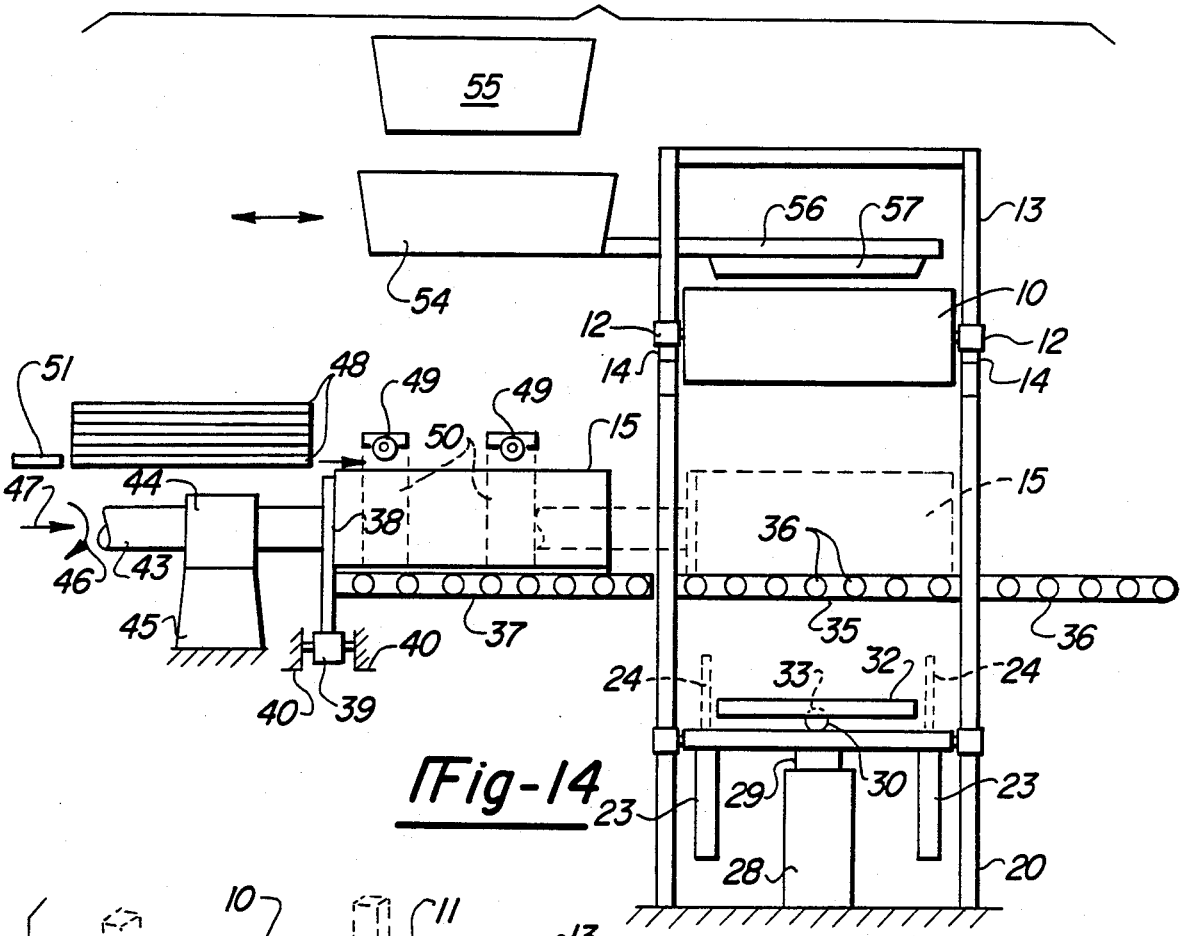
FIG. 14 schematically illustrates the complete sand moldforming machine.
Figure 15:
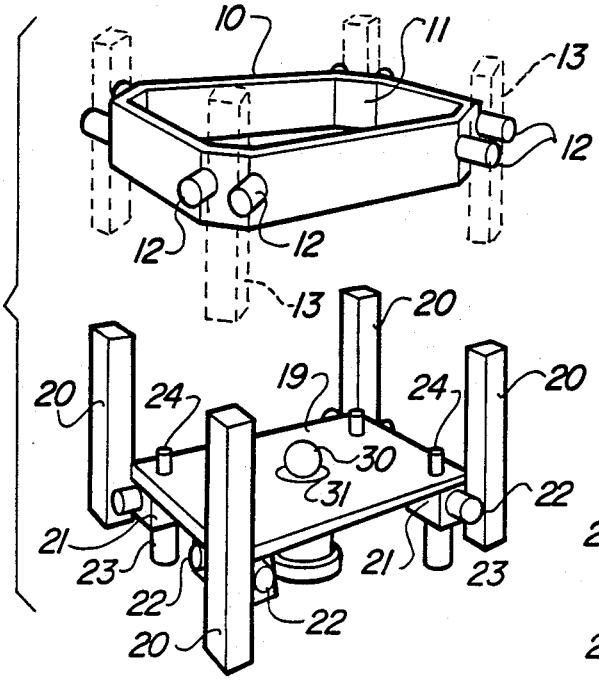
FIG. 15 is a schematic, perspective illustration of the arrangement of the vertically movable platen and the vertically movable cope flask with respect to their vertical guide rails.
Figure 16:
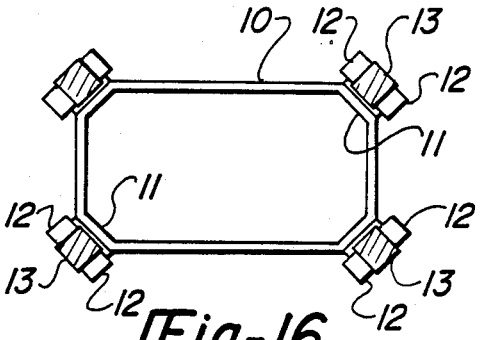
FIG. 16 is a schematic, plan view of the cope flask and its guide rails and guide rollers.
Figure 17:
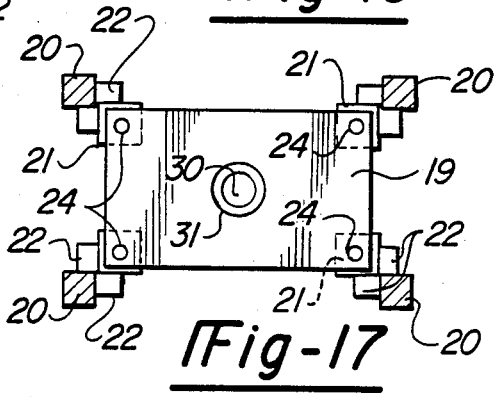
FIG. 17 is a schematic, plan view of the platen and its guide rails and guide rollers.

As illustrated in FIG. 11, after the drag flask has been laterally removed, the platen is again elevated so that the sand drag mold is lifted into surface-to-surface contact with the lower surface of the sand core mold which is still contained within the core flask. Then, the platen is retracted downwardly to lower the combined or assembled cope and drag sand molds. When the combined or closed sand mold reaches the level of the support tracks 37, they are laterally moved from beneath the cope flask for subsequent movement upon a suitable conveyor to a point where molten metal is cast into the sprue and thus into the enclosed casting cavity formed by the accurately registered cavities 73 and 74. The lateral movement of the sand mold may be affected by pushing it with the incoming loose sand-filled drag flask, as illustrated in FIG. 13. Then, the cycle, starting with FIG. 5, is repeated. The filling of the drag flask with the loose sand, as illustrated in FIGS. 1–4, is accomplished during the time that the drag mold is raised and then lowered, as indicated in FIGS. 11 and 12.

The closed flaskless mold or cake 78 is formed of tightly compressed sand which is sufficiently compacted to sustain its shape against the hydrostatic pressures of the molten metal cast in the closed cavity. After the metal is cast and solidified, the sand mold is broken to release the solid metal. Thereafter, the sand may be reused, as is common in foundry practice.

As described in the operation, the immobilizing of the drag flask while vertically lowering the sand drag mold in an accurate, vertically guided movement upon the guided platen, and thereafter raising the sand drag mold after the drag flask is laterally removed, produces a highly accurate registration of the cope and drag sand molds and their respective cavity portions and avoids any damage to the sand mold. This contrasts with the previous system where the drag flask has been lowered or removed from the cope with the sand drag mold contained therein and then, after removal, the sand drag mold is taken out of the drag flask. The misalignment and mold damage problems caused by the prior movement of the drag flask while it contained the sand drag mold are avoided by the present improved system.

This invention may be further developed within the scope of the following claims.

Accordingly, having described a fully operative embodiment of this invention, we now claim:

1. A method for registering the cope and the drag molds of a flaskless sand casting mold formed by compacting sand within vertically aligned cope and drag flasks against a pattern arranged upon a pattern board located between the vertically aligned cope and drag flasks, with portions of the pattern located upon the upper surface of the pattern board within the cope flask, and with portions of the pattern located upon the lower surface of the pattern board within the drag flask for forming vertically aligned mold casting cavities in the sand cope and drag molds, comprising:

closing the bottom of the drag flask with a support board and closing the top of the cope flask with a plate;

squeezing the support board and the plate relatively towards the pattern board to compact the sand within the cope and drag flasks and to form compacted sand cope and drag molds contained within the flask;

lowering the support board vertically downwardly for lowering the sand drag mold relative to the drag flask while holding the drag flask immovably against the cope flask;

then lowering the drag flask relative to the cope flask;

next, stopping the lowering movement of the drag flask and laterally moving the drag flask, with the pattern board, from between the sand drag mold and the cope flask;

vertically raising the support board until the sand drag mold engages the sand cope mold still contained in the cope flask to form the complete sand mold;

vertically lowering the support board for lowering the complete sand mold below the cope flask; and laterally moving the complete sand mold from beneath the cope flask to a different location for subsequent use in casting molten metal therein.

2. A method as defined in claim 1, and including continuing to vertically lower the support board, with the sand drag mold, after the drag flask begins lowering so that the two are lowered simultaneously after the initial lowering of the support board and drag sand mold during the time that the drag flask is held immobile against the cope flask, and stopping the lowering movement of the drag flask while continuing the lowering movement of the support board until the sand drag mold is located completely below the drag flask so that the drag flask is clear for lateral movement relative to the sand drag mold.

3. A method as defined in claim 2, and including stopping the lowering movement of the drag flask by engaging it upon a laterally directed track-like support means and after the sand drag mold is lowered below the drag flask, laterally moving the drag flask upon said track-like support means until it is laterally clear of the cope flask.

4. A method as defined in claim 3, and including filling the drag flask with sand and positioning the pattern board at the top of the drag flask and positioning the support board at the bottom of the drag flask for supporting the sand thereon, while the drag flask is laterally clear of the cope flask;

laterally moving the drag flask beneath and in vertical alignment with the cope flask and with the pattern board positioned to close the bottom of the cope flask; and filling the cope flask with sand prior to closing the top of the cope flask with the plate.

5. A method as defined in claim 1, and including engaging the lowering drag flask upon a fixed support means for stopping the lowering movement of the drag flask and for supporting the drag flask in a fixed horizontal position while the support board, with the sand drag mold supported thereon, continues lowering to a position where the drag mold is completely beneath the drag flask.

6. A method as defined in claim 5, and including guiding the movable support board for accurate vertical upwards and downwards movement for lowering the sand drag mold away from and for raising the sand drag mold in an accurate predetermined vertical direction for accurately registering the sand drag mold against the lower face of the sand cope mold.

7. A method as defined in claim 5, and including supporting the support board upon a vertically movable platen for raising and lowering the support board by movement of the platen;

providing the platen with vertically movable drag flask supported rod means whose upper portions engage and support the drag frame;

movably extending the rod means vertically upwardly relative to the platen as the platen is lowered so as to hold the drag flask upwardly against the cope flask until the sand drag mold has been substantially lowered relative to the drag flask and thereafter retracting the rod means vertically downwardly to lower the drag flask while the platen, with the sand drag mold, continues its lowering movement.

8. A method as defined in claim 7, and including retracting the rod means downwardly relative to the platen until the drag flask lowering movement is stopped and thereafter continuing lowering the rod means for disengaging it from the drag flask for permitting lateral movement of the drag flask.

9. A machine for forming and accurately registering the sand cope and drag of a flaskless casting mold, comprising:

spaced apart, vertically arranged guide rails;

a horizontal platen located between the rails and having guide means engaging the rails for guiding the platen for vertical movement relative to the rails;

a drag flask arranged to be temporarily located upon the platen and to be supported thereby for vertical, guided movement with the platen;

a cope flask located above the drag flask in vertical alignment therewith, so that the drag flask is vertically moved towards and away from the cope flask;

support rest means for engaging and supporting the drag flask in vertical alignment beneath the cope flask and above the platen and independently of the platen;

means for moving the drag flask laterally to a position located to the side of the cope flask and platen;

lift means for lifting the platen upwardly for thereby lifting the drag flask supported thereon upwardly into substantial engagement and registry with the cope flask;

separate, vertically extendable and retractable lift means mounted upon the plate for engaging and supporting the drag flask at predetermined times for holding the drag flask at a distance above the platen;

with said lift means holding the drag flask upwardly against the cope frame, independently of the platen, while the platen is lowered relative to the drag flask, and thereafter, retracting towards the platen to lower the drag flask into position for support by said support rest means, while the platen continues lowering to a position considerably beneath the drag frame;

whereby the drag flask may be raised substantially against the cope flask, and the drag flask and the cope flask may each contain a compressed sand mold formed therein, with corresponding open, casting cavities formed in each of their adjacent surfaces so as to form, together, an enclosed casting cavity within a complete, sand cope and drag flaskless mold, and thereafter, the sand drag mold, that was formed within the drag flask, may be lowered from the drag flask upon the platen, while the drag flask is held against the cope drag flask until the sand drag mold has moved downwardly a considerable distance, and then, the drag flask may be lowered by the lift means until it rests upon its support rests, while the lowering of the sand drag mold may be continued until the sand drag mold is well beneath the drag flask so that the drag flask can be laterally removed, and the drag mold may be vertically lifted, upon the platen, into vertical registry with the cope mold, still contained within the cope flask, to close the drag and cope sand molds together, so that the closed mold may then be lowered, upon the platen, beneath the cope flask and laterally removed for casting use.

10. A machine as defined in claim 9, and including said seperate lift means being formed of vertically movable lift rods mounted upon the platen for endwise movement upwardly and downwardly of the platen for engaging and supporting the drag flask and for retracting downwardly for lowering the drag flask relative to the cope flask and the platen.

11. A machine as defined in claim 9, and including said drag flask being supported, when not supported by the platen, upon a track-like support means upon which the drag flask may be laterally moved from beneath the cope flask to a location to the side of the cope flask and platen.

12. A machine as defined in claim 11, and including said drag flask support means comprising longitudinally extending tracks upon which the drag flask may be moved laterally of the guide rails and clear of the cope flask.

13. A machine as defined in claim 10, and including said lift rods being slidably mounted within cylinders carried by the platen so that the rods may be extended upwardly and downwardly relative to said cylinders.

14. A machine as defined in claim 11, and including a side station into which said drag flask may be laterally moved, and including means for filling the drag flask with sand at said side station so that the sand-filled flask may be returned laterally to its location in vertical alignment beneath and with the cope flask, and including means for filling the cope flask with sand.

15. A machine as defined in claim 9, and including said cope flask being vertically movable and including guide means engaging the cope flask with said rails for guiding the vertical movement of the cope flask, and including a squeeze plate located above the cope flask, whereby upward movement of the platen compresses the sand in the drag flask and also the sand in the cope flask.

16. A machine for forming and accurately registering the sand cope and drag molds of a flaskless casting mold, comprising:

a horizontal platen located between vertically arranged guide rails and having guide means for engaging the rails for guiding the platen for upwardly and downwardly vertical movement relative to the rails;

a cope flask located above the platen;

a drag flask arranged between the cope flask and the platen and arranged for temporary support upon the platen so as to vertically move upwardly towards and against the cope flask when the platen is raised;

support rest means for engaging and supporting the drag flask at a distance beneath the cope flask, and independently of the platen, so that the platen may be lowered relative to the drag flask;

means for moving the drag flask laterally from its support rest means to a location to the side of the cope flask and platen;

lift means for lifting the platen upwardly for thereby engaging and lifting the drag flask upwardly into substantial engagement and registry with the cope flask;

a cover arranged over the top of the drag flask and including pattern portions mounted upon the upper and lower surfaces of the cover for extending into the cope and drag flasks respectively when the two flasks are aligned in substantial engagement;

means for filling the cope and drag flasks with sand, and a squeeze plate located across the open top of the cope flask and a support board covering the open bottom of the drag flask and being supported by the platen;

whereby upward movement of the platen causes the drag flask support board to compress the sand contained within the drag flask against said cover and pattern to form a compacted sand drag mold, while simultaneously, the sand in the cope flask is compressed between the upper surface of the cover and the pattern and the cope flask cover plate to form a compressed sand cope mold;

said lift means lifting the platen upwardly and downwardly in guided vertical movement with respect to the guide rails;

separate, vertically extendable and retractable lift means mounted upon the platen for engaging and supporting the drag flask at predetermined times for holding the drag flask at a distance above the platen;

with said separate lift means holding the drag flask upwardly against the cope frame, independently of the platen, while the platen lift means lowers the platen relative to the drag flask for lowering the sand drag mold relative to the drag flask; and means for laterally moving the drag flask, when it is supported upon its support rest means and the sand drag mold is located beneath the drag flask, to a position alongside of the platen, so that the platen may be vertically raised to register the sand drag mold with the sand cope mold, and thereafter, the platen may be lowered to lower the entire sand mold, comprising the cope and drag sand molds in registry, beneath the cope flask for lateral movement into a separate location.

17. A machine as defined in claim 16, and including said separate lift means mounted upon the platen comprising vertically arranged rods mounted within cylinders mounted upon the platen for movement of the rods upwardly and downwardly relative to the cylinders for engaging the drag flask and holding it upwardly against the cope flask while the platen independently moves downwardly, and for retracting movement for lowering the drag flask along with the platen until the drag flask is rested upon its support rest and from disengaging from the drag flask thereafter.

* * * * *